US006012205A

United States Patent [19]

Bathelier et al.

[11] Patent Number: 6,012,205

[45] Date of Patent: Jan. 11, 2000

[54] METHOD AND DEVICE FOR MAKING TEXTILE PRODUCTS

[75] Inventors: Xavier Bathelier, Saint-Pierrement; Henri Genevray, Guebwiller, both of France

[73] Assignees: N.S.C. N.Schlumberger, Guebwiller; Cie and Sommer Revetements France S. A., Nanterre, both of France

[21] Appl. No.: 09/000,251

[22] PCT Filed: Jul. 26, 1996

[86] PCT No.: PCT/EP96/03342

§ 371 Date: May 1, 1998

§ 102(e) Date: May 1, 1998

[87] PCT Pub. No.: WO97/05315

PCT Pub. Date: Feb. 13, 1997

[51] Int. Cl.[7] ..... B32B 5/06

[52] U.S. Cl. ..... 28/107; 28/247

[58] Field of Search ..... 19/65 A, 66 CC, 19/66 R, 200, 300; 28/247, 260, 107

[56] References Cited

U.S. PATENT DOCUMENTS 5,239,734 8/1993 Bathelier et al. ..... 28/107

5,476,703 12/1995 Wattel et al. ..... 428/113

5,867,880 2/1999 Bathelier et al. ..... 28/107

FOREIGN PATENT DOCUMENTS 0 520 911 A1 12/1992 European Pat. Off. ..... D04H 1/70

WO 91/00382 1/1991 WIPO ..... D04H 11/08

*Primary Examiner*—Michael A. Neas

*Assistant Examiner*—Gary L. Welch

*Attorney, Agent, or Firm*—Alix, Yale & Ristas, LLP

[57] ABSTRACT

A method for making a textile product from a web of fibers and/or filaments moving in a feed direction. The method comprises a pre-looping step in which the fibers and/or filaments are individually transversely looped relative to the feed direction and optionally transversely stretched, whereafter they pile up in the form of a crimped pseudo-yarn in which the fibers and/or filaments are parallelized. Prior to the pre-looping step, the method comprises a crimping step in which the fibers and/or filaments are crimped with a spacing and a depth that are a multiple of the spacing and depth of the "crimp" formed in the pre-looping step.

9 Claims, 10 Drawing Sheets

METHOD AND DEVICE FOR MAKING TEXTILE PRODUCTS

CROSS-REFERENCE TO RELATED APPLICATIONS

This is the national stage of International Application Ser. No. PCT/EP96/03342 filed Jul. 26, 1996.

SUBJECT OF THE INVENTION

The present invention relates to an improved method for the manufacture of textile products directly from fibres and/or from filaments.

The invention also relates to a device for carrying out the method.

SUMMARY OF THE PRIOR ART

The present invention relates essentially to the production of products obtained by the technique which is known as "verticalization technique" and which has been refined by one of the Applicants.

This technique is described in the European patent EP-A-0,479,880 and makes it possible specifically to produce floor and/or wall coverings of the moquette type directly from fibres and/or from filaments travelling in the form of a web.

The technique described involves subjecting the fibres and/or filaments to "transverse looping" accompanied by "drawing" and obtaining an accumulation of the fibres and/or filaments in the form of a "pseudo-yarn", in which the fibres and/or filaments are parallelized. The pseudo-yarn is a non-twisted wavy yarn.

This document describes that transverse looping accompanied by drawing is carried out, for each individual fibre or filament, by means of rotary looping elements or discs which are spaced and arranged on a transverse axis with respect to the feed of the web and between which looping fingers are arranged. In this way, each fibre or filament is, in principle, involved in at least one looping, so as to form a twistless yarn obtained by the accumulation of the various exactly parallelized elementary fibres and/or filaments.

The conditions which had been established at the time when the abovementioned patent application was filed seemed to be twofold:

- on the one hand, most of the component elements of the web, that is to say the individual fibres and/or filaments, were to have an angle of orientation with respect to the feed direction of the web which was between 5 and 45 degrees and, more specifically, between 15 and 25 degrees;
- on the other hand, the web of fibres and/or filaments at the outset was to have a low weight per unit area, preferably between 10 and 50 g/m$^2$.

The condition relating to the orientation which the fibres and/or filaments must have with respect to the feed direction is a minimum condition of profitability where the lower angle is concerned. In fact, below a particular angle, the fibres and/or filaments risk no longer being parallelized correctly during the production of the pseudo-yarn, thus impairing the efficiency of the product. By contrast, where the maximum angle is concerned, this is an angle which constitutes a compromise between theory and practice, that is to say, in the event that fibres and/or filaments have an angle higher than this limit of 45 degrees, it is considered that, in theory, the method could still be carried out, but it is seen that the fibres and/or filaments would generate forces which increase exponentially with the angle of orientation of the fibres for the device formed by the interpenetration of the looping discs with the looping fingers, thus necessitating an oversizing of the parts and, in particular, of the shaft supporting the looping discs.

At the time when the prototype implementing the method described in this patent was being produced, the Applicant had therefore proposed satisfying the first of the conditions by ensuring an orientation of the fibres relative to the feed direction by means of "transverse pre-drawing" which was essentially carried out by the interpenetration of the two sets of discs arranged upstream of the looping-disc/looping-finger device.

Nevertheless, in the production of a machine having a width of, for example, 4 m, such a technical solution proved difficult to put into practice for the following reasons:

- the difficulty of controlling the lateral expansion of the web at high speed (formation of folds, . . . ) under satisfactory conditions of productivity,
- the difficulty of suitably orienting some types of fibres and, in particular, fibres having a length greater than 250 mm or continuous filaments.

A solution to this specific problem was proposed by the second Applicant. He proposes using a method which is described in the document EP-A-0,520,911, where a lap comprising a plurality of folds is produced from an entry web of fibres and/or filaments, which comes directly from a card, by passing the said web through a stretcher/lapper. This lap is subsequently passed through a drawframe equipped with rotary means which have, on their periphery, a clothing intended for drawing the lap.

Since, in order to utilize the so-called verticalization technique, it is necessary for the weight of the web to be kept below a particular limit, in practice one or two folds are made over the width of the web which is to re-enter the verticalization device.

The degree of drawing is adjusted in such a way that the fibres in the drawn product are mostly distributed in two orientations which are substantially symmetrical relative to the longitudinal direction of the drawn product.

Moreover, the longitudinal drawing of the lap emerging from the stretcher/lapper is preferably limited to 3. In fact, beyond such a limit, a non-homogeneous product taking the form of a "moth-eaten" product is often obtained. Such a product has randomly distributed gaps therein due to poor cohesion.

According to this embodiment described, the mean angle of orientation of the fibres and/or filaments is seen to be between 40 and 75 degrees relative to the longitudinal direction of the drawn product, which will be the feed direction of the web.

This angle is seen to be particularly high and is, in part, outside the ranges mentioned in the patent EP-A-0,479,880.

Nevertheless, according to such a configuration, it is still possible, at least in theory, to carry out a method such as that described in the said European patent.

In summary, it may be said that the main disadvantage of using an orientation device, such as that described in document EP-A-0,520,911 and which consists of a stretcher/lapper followed by a drawframe, is that the angle, at which the component elements of the web are presented at the entrance of the verticalization device, is too large. In this particular case, the forces exerted on the looping discs and, more particularly, on the shaft supporting these discs are considered to be too high.

One solution would, of course, be to increase the size of the shaft carrying the various looping discs and, consequently, the size of the latter. However, the configuration allowing the "automatic" accumulation of the fibres and/or filaments in the form of a yarn is made possible only for disc diameters smaller than a particular diameter.

This therefore likewise limits the diameter of the shaft carrying the various looping discs.

Another problem is that, according to the embodiment described in the patent EP-A-0,479,880, the configuration of the teeth present on the looping discs is provided so as to detach and strip the fibres and/or filaments in contact with the needles. This configuration is not conducive to the engagement of the web between the looping discs and fingers.

Particularly after a stoppage, the re-engagement of the web may be lengthy and difficult, and even dangerous if manual action is taken. Moreover, the devices are placed upstream of the looping-disc/looping-finger device, such as the card and lapper, have high inertia, thus inevitably causing productivity to fall below acceptable limits.

OBJECTS OF THE INVENTION

The present invention aims to provide a solution to the problem encountered in the prior art, that is to say a solution which would make it possible to reduce the generated forces to a particularly appreciable extent by preferably using the stretcher/lapper device followed by a drawframe, as described in the document EP-A-0,520,911, in order to orient suitably the fibres and/or filaments intended to be used in a verticalization method and device, such as are defined in the document EP-A-0,479,880.

The present invention is also aimed at solving the problem of the poor engagement of the web between the looping discs and fingers.

Other advantages will emerge from the following description.

Principal Characteristic Elements of the Present Invention

The present invention relates to a method for the manufacture of a textile product from fibres and/or filaments travelling in the feed direction in the form of a web, comprising in the conventional way a step called a pre-looping step, in which the fibres and/or filaments individually undergo looping transversely to the feed direction, if appropriate accompanied by transverse drawing, and accumulate in the form of a crimped pseudo-yarn, in which the fibres and/or filaments are parallelized. The method is characterized in that a step which is prior to the pre-looping step and which is called the "crimping step" is carried out. If the pre-looping step is carried out by means of a device formed by the interpenetration of a first set of looping discs with a first set of looping fingers, the crimping step is carried out by means of a device formed by the interpenetration of a second set of discs, called crimping discs, with a second set of fingers, called crimping fingers, this device being arranged upstream of the pre-looping device with respect to the feed direction of the web. In order to put the method according to the present invention into practice, it is necessary for the crimping device to have a gauge which is a multiple of the gauge of the pre-looping device (that is to say, $n \times j$ if j is the gauge of the pre-looping device). On the other hand, the dimensions and arrangement of the various elements of the crimping device must be calculated in such a way that the length of a crimp obtained within the crimping device is approximately equal to the number of times the gauge of the pre-looping device has been multiplied within the crimping device.

According to a first particularly simple embodiment, it is sufficient to provide a gauge for the crimping device which is double the gauge of the pre-looping device. In this case, the length of a crimp obtained within the crimping device is equal to twice the length of a crimp produced within the pre-looping device. Even in this embodiment, depending on the materials used, the forces will be divided by a factor of 5 to 10 with respect to the particular example in which a crimping device is not used.

According to an embodiment which is also preferred, it is conceivable to provide a second crimping device located upstream of the preceding crimping device and having a gauge which is, once again, a multiple of the gauge of the preceding crimping device.

According to another embodiment, it would also be conceivable to interpose an additional crimping device having a gauge j between the crimping device having a gauge nj and the pre-looping device, as defined above, having a gauge j. In this case, the pre-looping device is intended solely for forming the crimped yarn by an accumulation of the fibres and/or filaments.

Advantageously, it may be seen that the diameters of the crimping discs and of the shaft supporting these crimping discs of the crimping device or crimping devices arranged upstream of the pre-looping device are not limited to the considerations regarding the accumulation of the fibres and/or filaments in the form of a yarn and may therefore be particularly large.

Likewise, the design is not governed by the considerations regarding the accumulation of the various fibres in the form of a yarn at the end of the looping fingers. It is therefore likewise possible to provide for the teeth of the discs of the crimping device or crimping devices a profile which is completely different from that of the looping discs of the pre-looping device intended to be forming the yarn. In particular, it is conceivable for the crimping discs for the crimping device or crimping devices to have a toothing inverted in relation to those of the pre-looping device for the purpose of making the engagement of the web easier.

It goes without saying that the present method and the present device must be considered as emanating from the method and device described in the document EP-A-0,479,880 of one of the two Applicants, and that all the subsidiary characteristics and the improvements described in this document may, of course, be applied to the present method.

DESCRIPTION OF A PREFERRED EMBODIMENT OF THE PRESENT INVENTION

Figure 1:
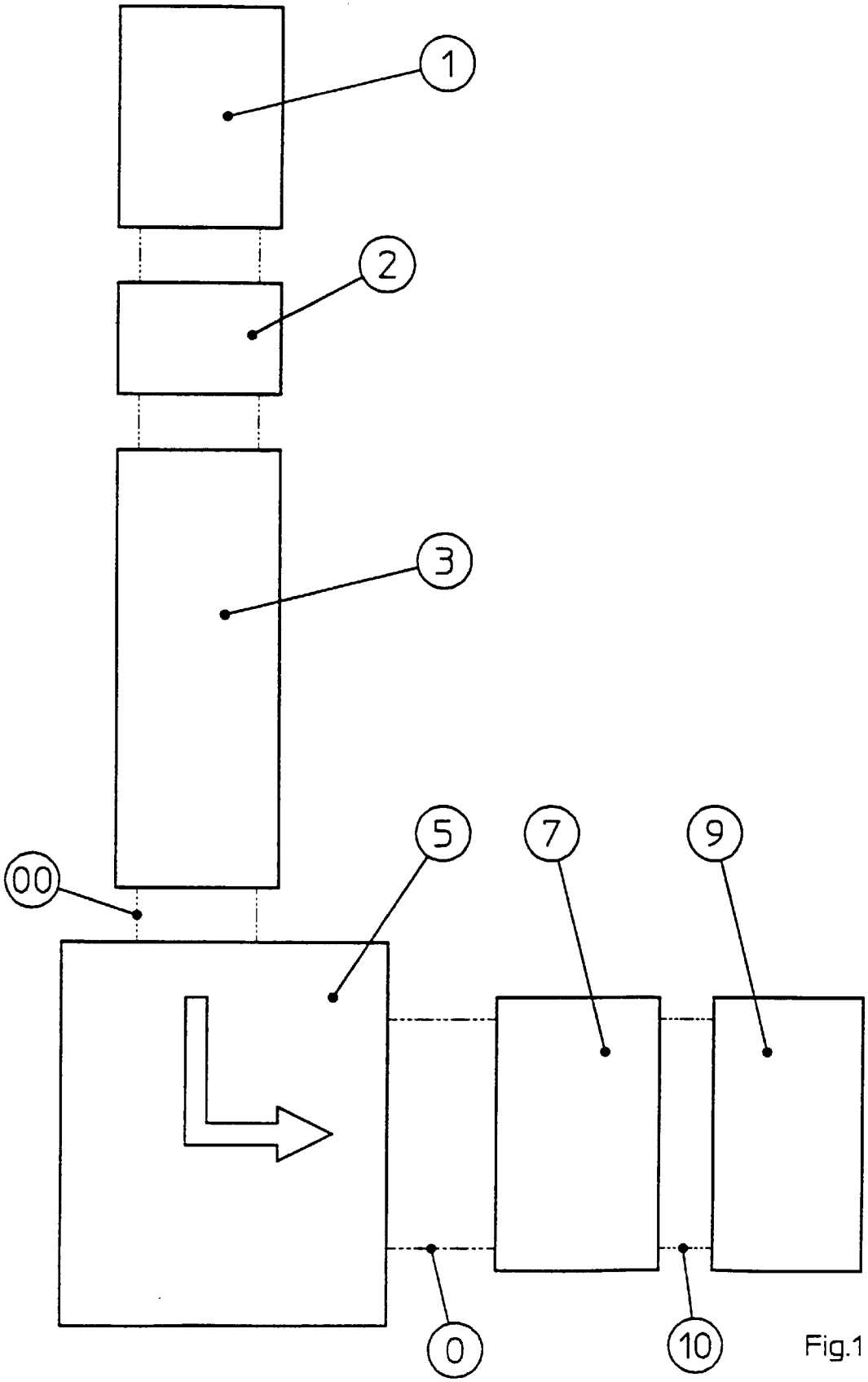
FIG. 1 shows a particular embodiment of the fibre and/or filament orientation device intended to be used in a so-called verticalization method.

FIG. 1 shows a diagrammatic view of a device which could be called a fibre and/or filament orientation device and which was the subject of a detailed description in the document EP-A-0,520,911.

According to the embodiment shown in FIG. 1, the fibres and/or filaments undergo, at 1 and 2, a step for mixing and opening the materials, so as to form a first web 00 after passing through a card 3, the said web having a weight of approximately 20 g/m$^2$ for a width of 2.5 m. The feed speed is approximately 100 m/minute.

At this level, the web is processed according to the technique described in European patent EP-A-0,520,911, that is to say it is introduced into a stretcher/lapper 5 in such a way that the web of fibres and/or filaments which comes from the card 3 is folded several times in succession.

The folded web which is also called a "lap" 0 is subsequently introduced into a drawframe 7, such as that described in the document EP-A-0,520,911. This device is equipped with rotary means which have, on their periphery, a clothing comprising spikes which are caused to penetrate into the lap 0.

For the purpose of producing a web 10 intended for a verticalization machine of a width greater than 4 m, it is, of course, necessary for the length of the stretcher/lapper device to be greater than this value and preferably to be of the order of 5 m.

Since one of the conditions for carrying out the so-called verticalization method is that the weight of the web 10 must remain relatively low, according to the present embodiment only one or two folds are made by means of the stretcher/lapper device 5.

The degree of drawing of the drawframe device is likewise adjusted in such a way that the fibres and/or filaments in the drawn web 10 are mostly distributed in two directions substantially symmetrical relative to the longitudinal direction of the drawn product, the said longitudinal direction being the feed direction of the web 10.

The angle a2, at which the fibres are mostly oriented relative to this feed direction, can be calculated easily. In fact, if:

Le is the entry width of the web 00,
Np is the number of folds made by the lapper,
Ls is the width of the folded lap 0,
a1 is the lapping half-angle relative to the feed direction of the web 00,
E is the drawing rate,
Le2 is the width of the web 10 at the exit of the drawframe, and
a2 is the half-angle after drawing relative to the feed direction of the web 00 which is orthogonal to the feed direction of the web 10, the following is easily obtained:

$$tg(a1) = \frac{Le}{(2 \cdot Np \cdot Ls}$$

-continued $$tg(a2) = \frac{(Le \cdot E)}{(2 \cdot Np \cdot Le2}$$

It may be seen, in practice, that the drawing rate is preferably limited to 3, in order to avoid poor cohesion of the web (moth-eaten product).

This means that, according to this exemplary embodiment, an angle a3 (complementary with a2) of between 40 and 75 degrees will be obtained.

Figure 2A:
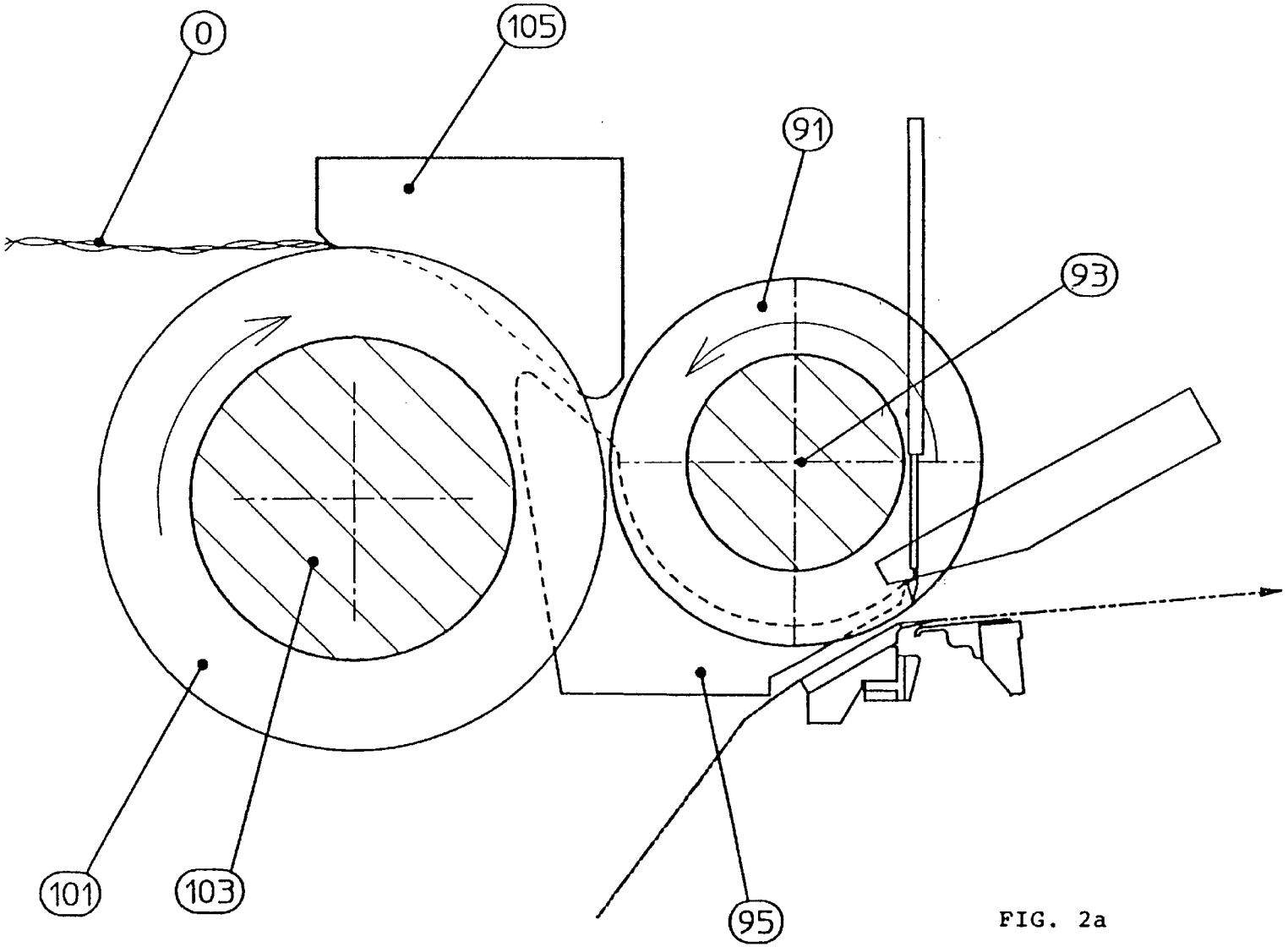
FIGS. 2*a* and 2*b* describe a diagrammatic profile view of the verticalization device according to two embodiments of the present invention.
Figure 2B:
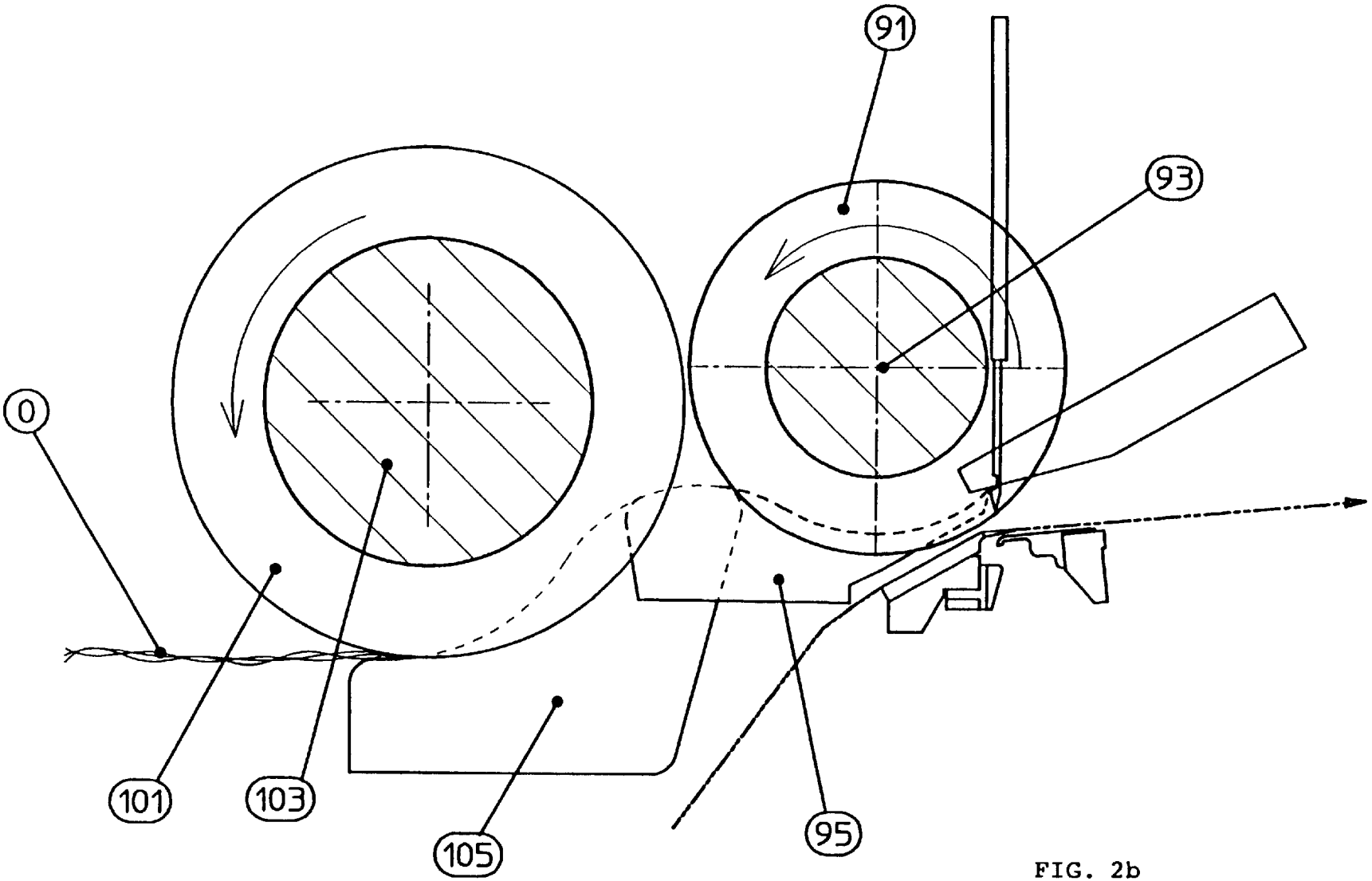

FIGS. 2*a* and 2*b* show the verticalization device according to two embodiments of the present invention. In each case, this device consists conventionally of a first set of looping discs 91 which are arranged on a transverse shaft 93 and between which looping fingers 95 come into place.

According to the present invention, a second device, called a crimping device, is arranged upstream of the pre-looping device. This crimping device consists of a set of crimping discs 101 which are arranged on a shaft 103 and between which crimping fingers 105 come into place.

According to the embodiment as shown in FIG. 2*a*, the crimping fingers 105 and looping fingers 95 are arranged in opposition in relation to the respective crimping and looping discs. This allows the web to engage in an "S"-shaped manner between the crimping and looping discs.

According to the embodiment as shown in FIG. 2*b*, the crimping fingers 105 and looping fingers 95 are arranged on the same side in relation to the crimping and looping discs, thus assisting the engagement of a web in a, for example, "V"-shaped manner.

It is expedient to note that the gauge assumed by the crimping discs of the crimping device is a multiple of the gauge of the pre-looping device.

FIGS. 2*a* and 2*b* show two particularly simple embodiments, where there is a gauge 2*j* of the crimping device for a gauge j of the pre-looping device.

It goes without saying that other embodiments which make it possible to have a higher multiplication factor or a succession of a plurality of crimping devices are likewise conceivable.

FIG. 3 show several front views of the various elements forming the two pre-looping and crimping devices, the looping and crimping discs and fingers being shown diagrammatically.

Figure 3A:
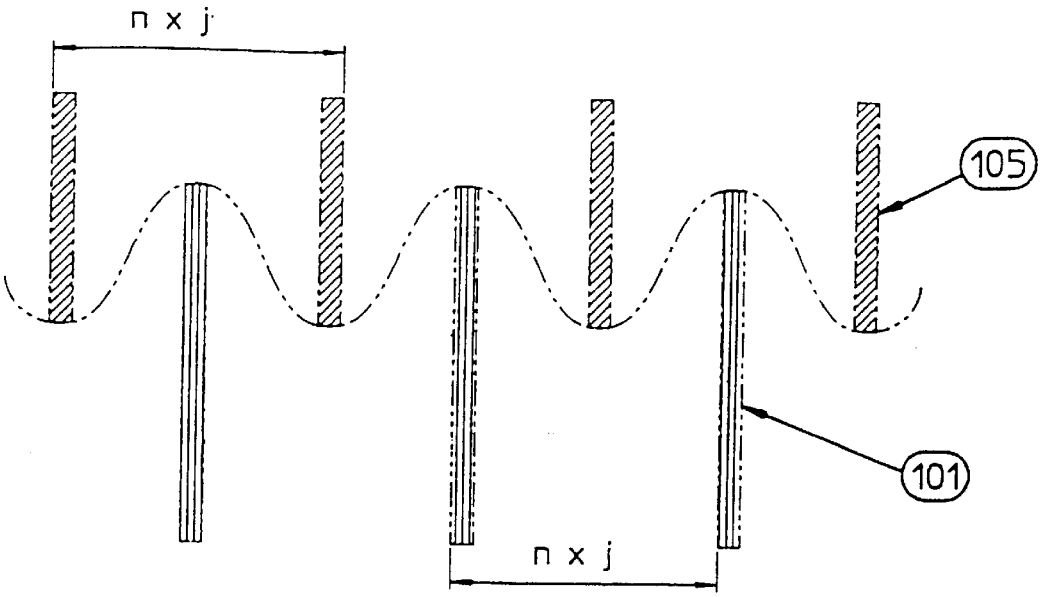
FIGS. 3*a*, 3*b* and 3*c* show several front views for different steps in the feed of the fibres and/or filaments through the crimping and pre-looping devices.

More particularly, FIG. 3*a* shows the behaviour of the fibres and/or filaments within the device called a crimping device, which is located furthest upstream in relation to the feed direction of the web 10. It can be seen that the fibres and/or filaments which meet this crimping device will experience individually the production of a crimp having a period which, of course, is equal to the gauge of the crimping device.

According to the embodiment shown in FIG. 3, the gauge of the crimping device is simply double that of the pre-looping device, where the formation of the actual yarn takes place.

Figure 3B:
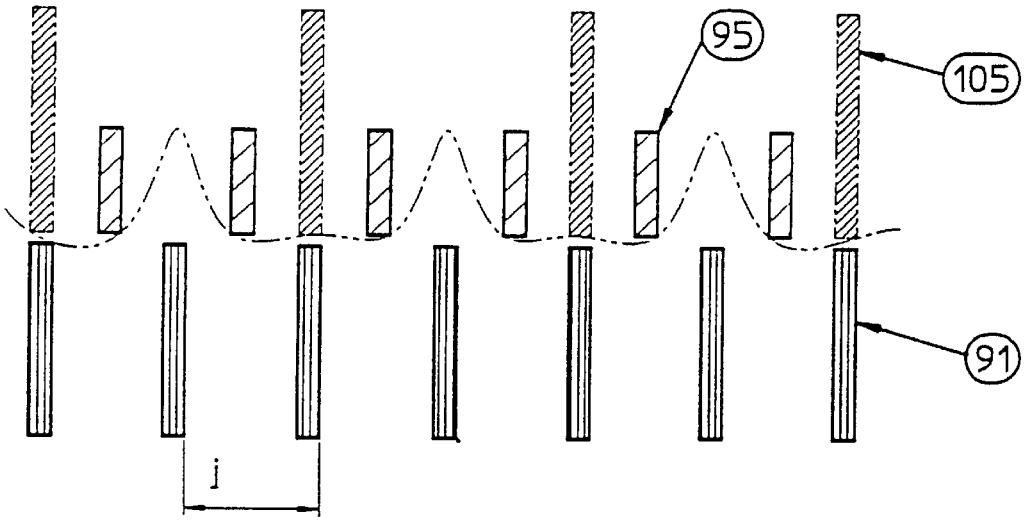

FIG. 3*b* shows the step of transferring the fibres and/or filaments between the crimping device and the pre-looping device. In this case, the looping discs 91 of the pre-looping device are arranged exactly in the extension of the fingers 105 of the crimping device, but also in the extension of the discs 101 of the crimping device. Consequently, it may be seen that there are twice as many discs in the pre-looping device as in the crimping device.

It is, of course, conceivable to replace the crimping fingers by any other curvilinear element which would have the same function.

Figure 3C:
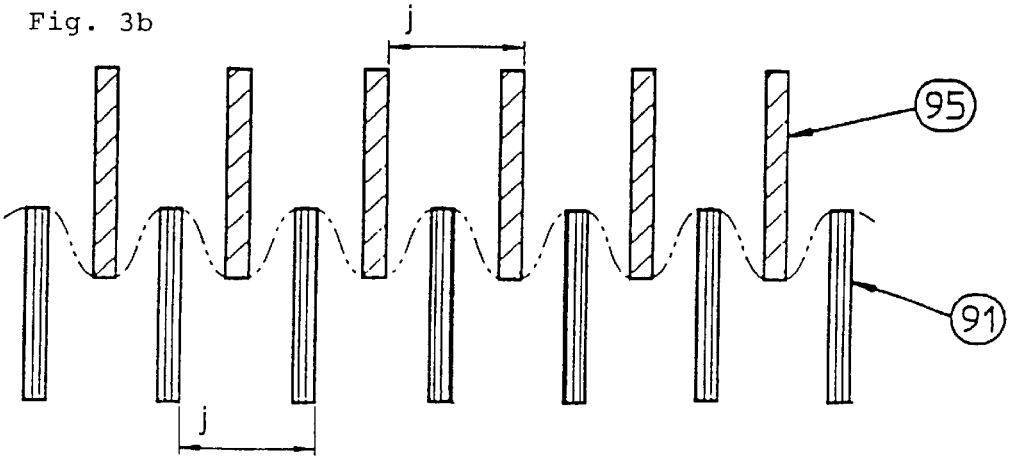

FIG. 3*c* shows the behaviour of the fibres and/or filaments within the device called a pre-looping device, which is located furthest downstream and which makes it possible to produce the crimped pseudo-yarn obtained by the accumulation of the fibres and/or filaments.

If the pre-looping device has a gauge twice as low as that of the crimping device, it is important to check that the length of the crimp obtained for the fibres and/or filaments in the crimping device is equal to or near double the length of the crimp of the fibres and/or filaments produced by the pre-looping device for the purpose of forming the pseudo-yarn.

This avoids any additional drawing within the material in the pre-looping device, the drawing force being absorbed virtually completely by the first shaft carrying the crimping discs.

In order to achieve this aim, it is necessary to calculate accurately the arrangement and size of the various crimping or looping discs in relation to the corresponding crimping or looping fingers and, in particular, their rate of interpenetration within the crimping and pre-looping devices.

Figure 4:
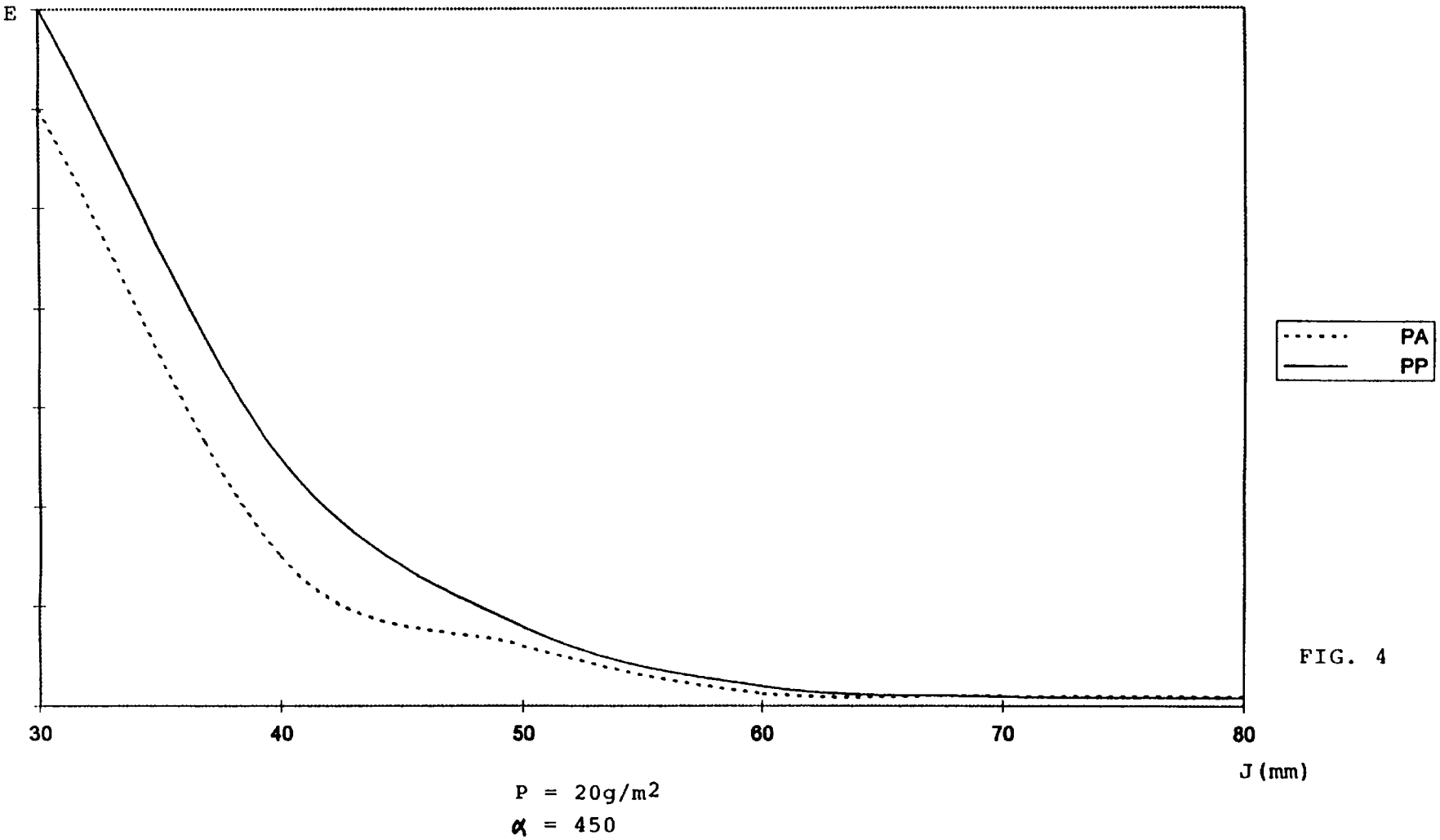
FIGS. 4, 5 and 6 show the looping forces for a web, given as a function of the gauge (FIG. 4), as a function of the weight of the web (FIG. 5) and as a function of the angle of orientation of the fibres (FIG. 6).
Figure 5:
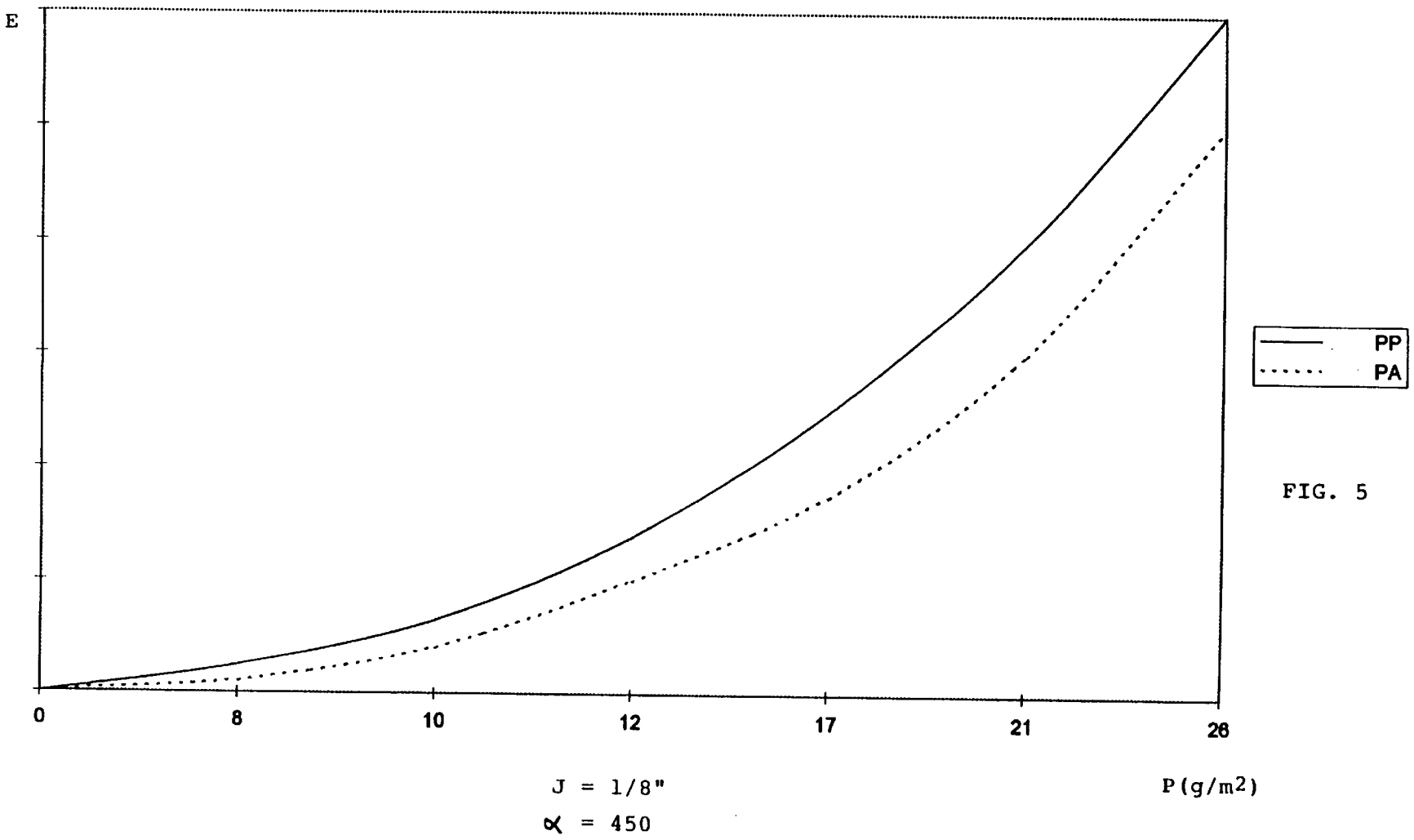
Figure 6:
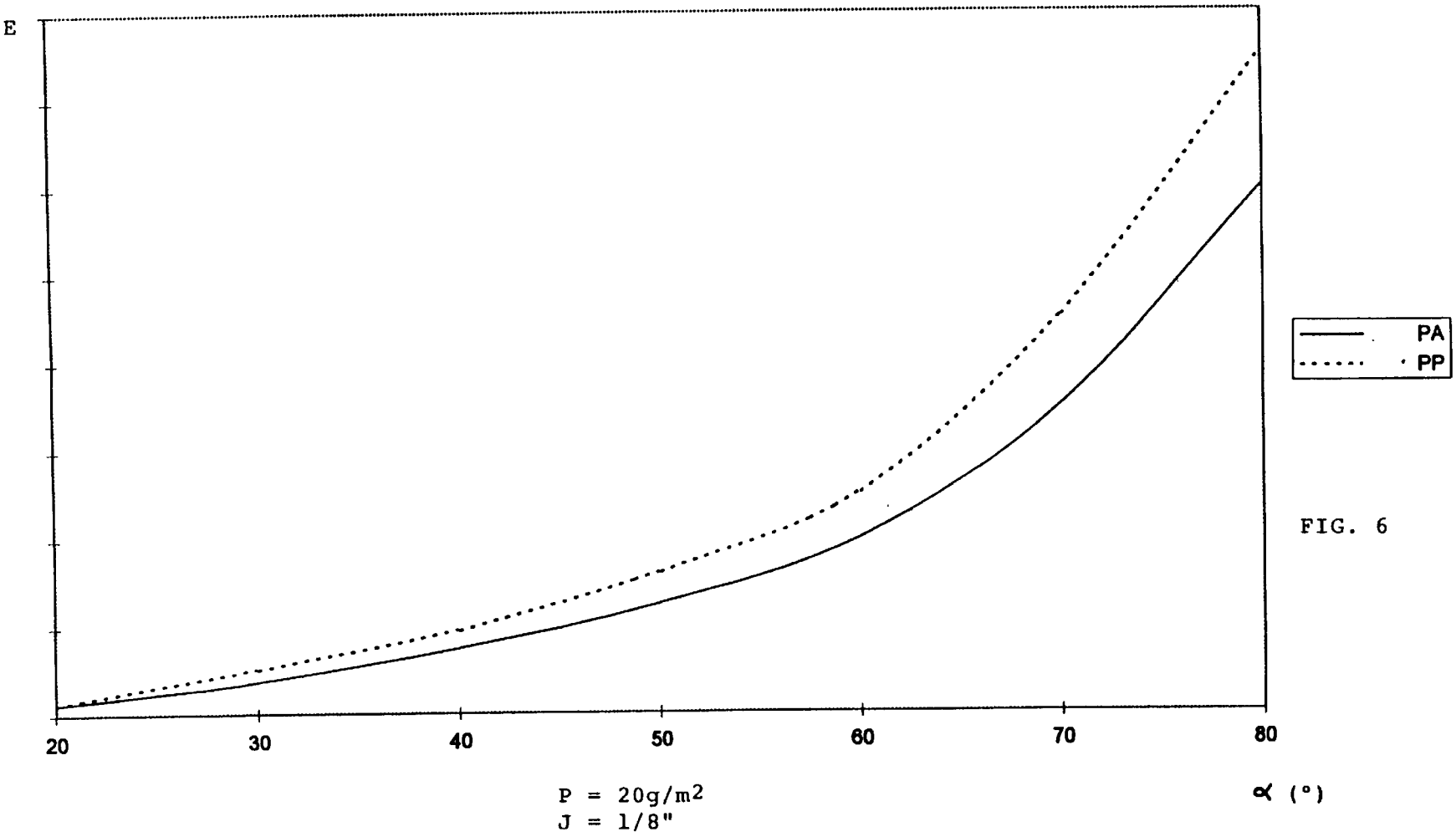

FIGS. 4, 5 and 6 show the looping forces either as a function of the gauge or as a function of the weight of the web or as a function of the angle of orientation of the fibres, the other parameters being fixed in each case.

More particularly, FIG. 4 shows the crimping forces as a function of the gauge in the case of a constant web weight selected at 20 g/m$^2$, and in which the fibres have a mean angle of orientation of 45 degrees relative to the feed direction. These forces were calculated for two types of material: a polyamide web (PA) and a polypropylene web (PP). Nevertheless, it may be seen that the results are somewhat similar in both cases and decrease spectacularly as a function of the gauge, particularly in the range of a gauge of ⅛ inch (3.175 mm) to ⅜ inch (6.136 mm).

It is estimated that, for a web of 20 g/m$^2$ approaching a pre-looping device having a gauge (of ⅜ inch) double that of the final looping device having a gauge of ⅛ inch, the forces obtained within the final looping device have decreased by a factor of 4, as compared with the situation where no pre-looping device was used.

FIG. 5 shows the crimping forces as a function of the web weight P (g/m$^2$) for a fixed gauge selected at ⅛ inch, and in which the fibres have a mean angle of orientation of 45 degrees relative to the feed direction, once again with regard to a polypropylene web (PP) and the polyamide web (PA).

It can be seen that the behaviours are somewhat similar for both types of web, and that the forces increase considerably from a value higher than 20 g/m$^2$.

FIG. 6 shows the crimping forces as a function of the angle of orientation $\alpha$ of the fibres for a web having a weight of 20 g/m$^2$, and where the gauge is of ⅛ inch, this being for two materials, a polyamide web (PA) and a polypropylene web (PP).

It can be seen, once again, that the forces increase exponentially as a function of the angle of orientation of the fibres.

Another particularly important aspect of the present invention is that the problem of the poor engagement of the web in the verticalization device is solved.

In fact, the crimping device is no longer subjected to the same conditions regarding the toothing as the pre-looping device which must allow the fibres and/or filaments to accumulate in the form of a yarn.

In fact, according to the document EP-A-0,479,880, it was necessary for the toothing of the looping discs located in the pre-looping device to be designed in such a way as to obtain a correct and appropriate accumulation of the fibres and/or filaments in the eyes of the needles in order to produce a crimped yarn, which, of course, is no longer the case for the toothing of the crimping discs of the crimping device.

In particular, it would be conceivable for the toothing of the crimping discs of the crimping device to be produced in such a way as to assist the engagement of the web in the verticalization device.

Figure 7:
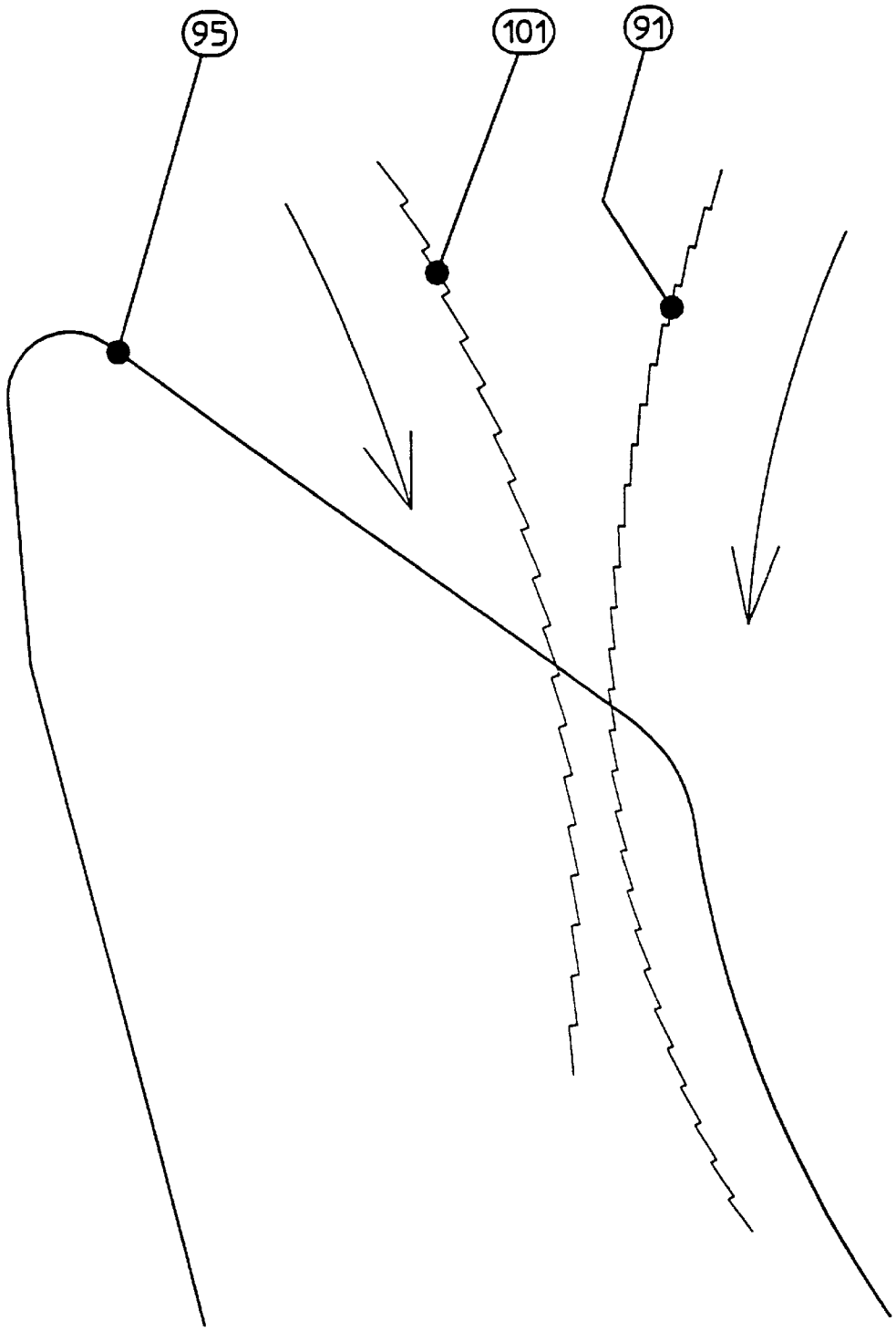
FIG. 7 shows a detailed view illustrating the toothing of the various crimping and looping discs.

FIG. 7 shows the toothings of the crimping and pre-looping devices. It can be seen that the toothing of the crimping device is inverse to that of the pre-looping device and will assist the engagement of the web.

Figure 8:
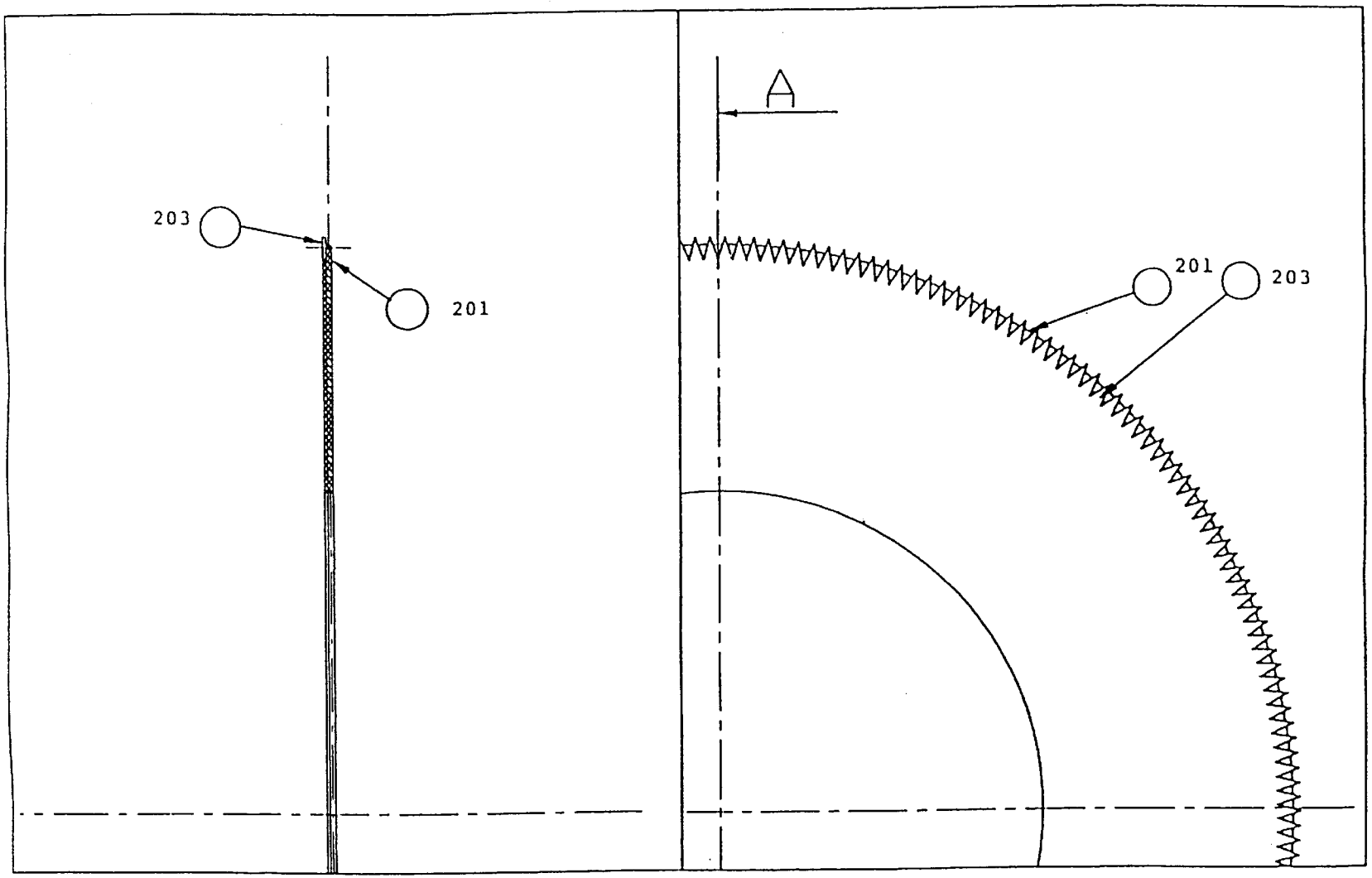
FIG. 8 shows a sectional view of a preferred embodiment of discs used in the crimping step and of the toothing present there.

FIG. 8 shows an exemplary embodiment of crimping discs which can be used in the crimping device and which have a toothing which allows the web to engage easily and be driven in the verticalization device.

According to this embodiment shown, the crimping disc consists essentially of two parts:

- the first part is a perfectly polished chamfered disc 201 which, if appropriate, has undergone surface treatment for the purpose of lowering the coefficient of friction with the fibre. This disc forms the base of the toothing and allows the fibres and/or filaments to slide laterally easily,
- the second part of the disc consists of a cut-out disc 203 which will, for example, be welded to the first and which makes it possible to form the tip of the toothing allowing the web to be engaged and driven.

Using crimping discs, such as those shown in FIG. 8, an excellent behaviour of the material is seen, also making it possible to reduce the crimping forces within the crimping device.

Figure 9:
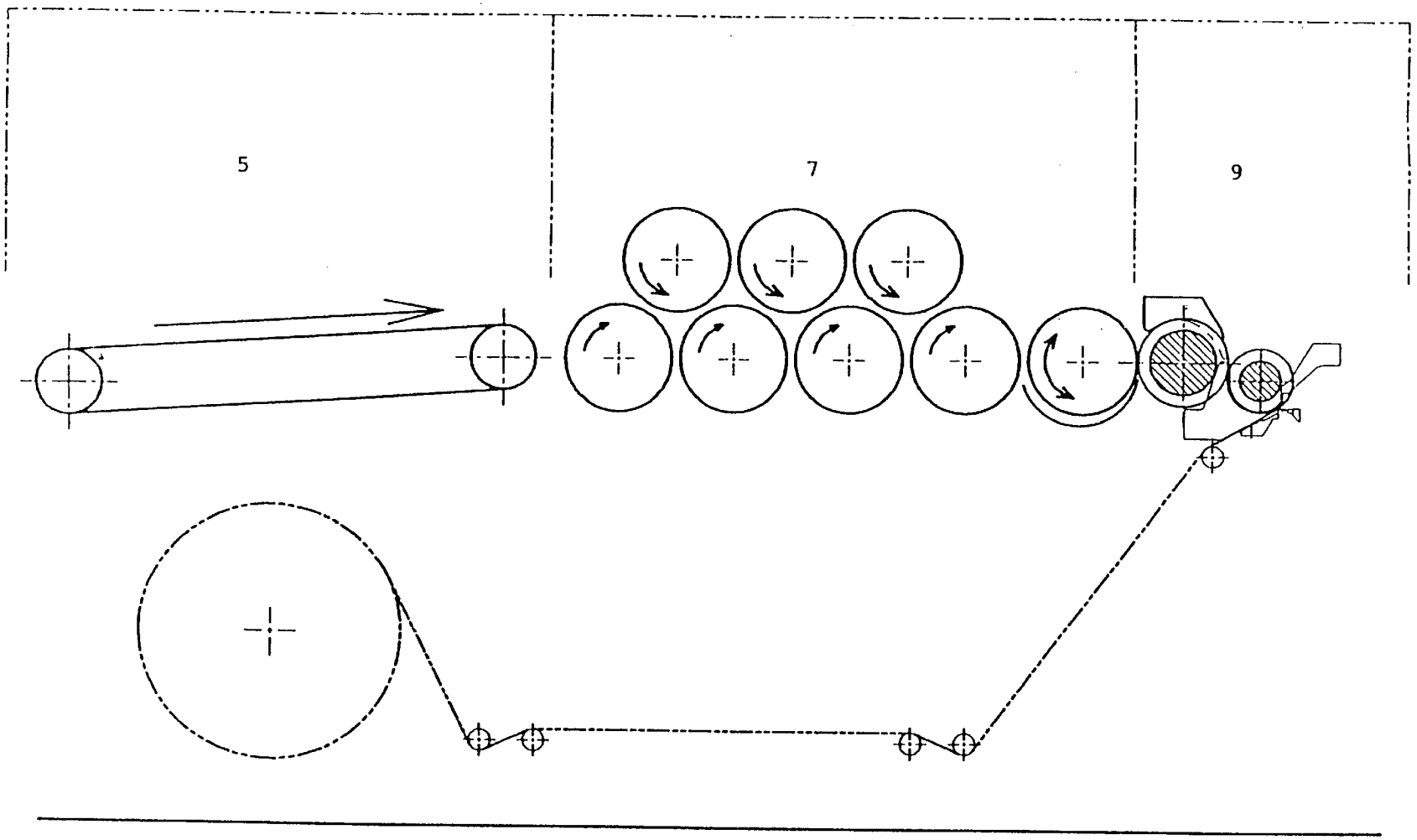
FIG. 9 shows a preferred embodiment, in which the link between the drawframe device, as described in the document EP-A-0,520,911, and the device according to the present invention appears.

FIG. 9 shows the drawframe device, as described in the document EP-A-0,520,911, which consists of a series of successive cylinders and in which the last cylinder belonging to this drawframe device 7 is in the extension of the first of the crimping discs of the crimping device 9, in such a way that the web consisting of the fibres and/or filaments can be driven directly at the exit of the drawframe device.

What is claimed is:

1. Method for the manufacture of a textile product from fibres or filaments traveling in the feed direction in the form of a web, comprising a pre-looping step, in which the fibres or filaments individually undergo looping transversely to the feed direction, said pre-looping having a designated spacing and depth, and accumulate in the form of a crimped pseudo-yarn, in which the fibres or filaments are parallelized, characterized in that a step prior to the pre-looping step is carried out, said step being called a crimping step and involving subjecting the fibres or filaments to crimping, the spacing and depth are equal to a multiple of the spacing and depth of the crimp produced in the pre-looping step.

2. Device for carrying out a method for the manufacture of a textile product from fibers or filaments in a feed direction in the form of a web, which device is called a pre-looping device and which web is formed by the interpenetration of a first set of looping discs (91) with a first set of looping fingers (95), characterized in that the device also comprises a crimping device formed by the interpenetration of a second set of discs, called crimping discs (101), with a second set of fingers, called crimping fingers (105), the spacing of said crimping discs being equal to a multiple of the spacing of the looping discs.

3. Device according to claim 2, characterized in that the dimensions and arrangement of the discs and fingers of the crimping device are calculated in such a way that the depth of the crimp obtained within the crimping device is equal to a multiple of the spacing of the pre-looping device.

4. Device according to claim 2, characterized in that the disc spacing of the crimping device is equal to double the disc spacing of the pre-looping device.

5. Device according to claim 2, characterized in that a second crimping device is arranged upstream of the preceding crimping device, said second crimping device having a spacing which is equal to a multiple of the spacing of the preceding crimping device.

6. Device according to claim 2, characterized in that an additional crimping device is interposed between the crimping device and the pre-looping device, said additional crimping device having a spacing which is equal to the spacing of the pre-looping device.

7. Device according to claim 2, characterized in that the crimping discs of the crimping device and the looping discs of the looping device are provided with teeth where the teeth of the crimping discs are different in size than the teeth of the looping discs.

8. Device according to claim 2, characterized in that the diameter of the crimping discs belonging to the crimping device is at least equal to the diameter of the looping discs of the pre-looping device.

9. Device according to claim 2, characterized in that the crimping discs are produced in two parts, the first part consisting of a perfectly polished chamfered disc (201) which, has undergone surface treatment in order to lower the coefficient of friction with the fibre, and the second part consisting of a cut-out disc (203) secured to the first part and forming the tip of the toothing.

* * * * *

UNITED STATES PATENT AND TRADEMARK OFFICE

CERTIFICATE OF CORRECTION

PATENT NO. : 6,012,205
DATED : January 11, 2000
INVENTOR(S) : Xavier Bathelier et al.

It is certified that error appears in the above-identified patent and that said Letters Patent is hereby corrected as shown below:

Title page,
Item [73], Assignee, before the comma, insert -- & Cie -- and delete "Cie and".
Insert Item
-- [30] Foreign Application Priority Data
August 1, 1995 [EP] European Pat. Off. ……. 95870093 --.

Signed and Sealed this

Twenty-second Day of March, 2005

JON W. DUDAS
*Director of the United States Patent and Trademark Office*